US008695551B2

(12) United States Patent
Langewisch et al.

(10) Patent No.: US 8,695,551 B2
(45) Date of Patent: Apr. 15, 2014

(54) HYDRAULIC LASH ADJUSTER INCLUDING BAND OF RADIAL RECIRCULATION OPENINGS

(75) Inventors: Edwin Henry Langewisch, Dunlap, IL (US); Ashwin A. Hattiangadi, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 323 days.

(21) Appl. No.: 13/166,841

(22) Filed: Jun. 23, 2011

(65) Prior Publication Data

US 2012/0325171 A1 Dec. 27, 2012

(51) Int. Cl.
*F01L 1/18* (2006.01)

(52) U.S. Cl.
USPC ..... 123/90.45; 123/90.12; 123/90.52; 123/90.55

(58) Field of Classification Search
USPC ..... 123/90.39, 90.44, 90.45, 90.12, 90.52, 123/90.55
See application file for complete search history.

(56) References Cited

U.S. PATENT DOCUMENTS

| | | | |
|---|---|---|---|
| 2,237,854 | A | 4/1941 | Voorhies |
| 2,665,669 | A | 1/1954 | Ellis |
| 2,754,811 | A | 7/1956 | Dayton |
| 3,897,761 | A | 8/1975 | Fleischer et al. |
| 4,184,464 | A | 1/1980 | Svihlik |
| 4,228,771 | A | 10/1980 | Krieg |
| 4,407,241 | A | 10/1983 | Butler et al. |
| 4,470,382 | A | 9/1984 | Muto |
| 4,535,734 | A | 8/1985 | Kodama et al. |
| 4,815,424 | A | 3/1989 | Buuck et al. |
| 5,245,958 | A | 9/1993 | Krieg et al. |
| 5,622,147 | A | 4/1997 | Edelmayer |
| 5,901,676 | A | 5/1999 | Edelmayer |
| 7,464,678 | B2 | 12/2008 | Rozario et al. |
| 7,644,693 | B2 | 1/2010 | Cecur |
| 2009/0173303 | A1 | 7/2009 | Edelmayer |
| 2010/0071649 | A1 | 3/2010 | Janowiak |

FOREIGN PATENT DOCUMENTS

| | | | |
|---|---|---|---|
| DE | 102005049423 | A1 | 4/2007 |
| EP | 1002938 | A2 | 5/2000 |
| FR | 1499504 | A | 10/1967 |
| FR | 2674570 | A1 | 10/1992 |
| GB | 2095357 | A | 9/1982 |
| GB | 2112896 | | 7/1983 |

*Primary Examiner* — Ching Chang
(74) *Attorney, Agent, or Firm* — Liell & McNeil

(57) ABSTRACT

A hydraulic lash adjuster includes a body defining an axial bore and having an open end and a closed end. A hollow piston is telescopically received within the axial bore and defines a fluid reservoir. The hollow piston has a first end disposed within the axial bore and a second end extending outwardly beyond the open end of the body. A high pressure volume is defined by the axial bore and the first end of the hollow piston. The hydraulic lash adjuster also includes a valve mechanism positioned through an opening of the hollow piston and including a valve member having an open position defining a fluid path from the fluid reservoir to the high pressure volume. The valve member also has a closed position in which the fluid reservoir is fluidly blocked from the high pressure volume at the opening. The hollow piston includes a band of radial recirculation openings defining recirculation paths from the high pressure volume to the fluid reservoir along an exterior of the hollow piston. A diameter of each of the radial recirculation openings is smaller than a width of the band.

11 Claims, 2 Drawing Sheets

HYDRAULIC LASH ADJUSTER INCLUDING BAND OF RADIAL RECIRCULATION OPENINGS

TECHNICAL FIELD

The present disclosure relates generally to a hydraulic lash adjuster, and more particularly to a hollow piston of a hydraulic lash adjuster having a band of radial recirculation openings for recirculating leaked hydraulic fluid.

BACKGROUND

Hydraulic lash adjusters are known for use in internal combustion engines to reduce clearance, or lash, between valve train components, and also to maintain engine efficiency, reduce engine noise, and reduce wear in the valve train. Hydraulic lash adjusters operate by transmitting rotational energy of the camshaft through hydraulic fluid trapped in a high pressure volume beneath a piston. During operation of the camshaft, as the length of the valve train components varies due to operational changes, such as thermal stresses, small quantities of hydraulic fluid are permitted to enter or escape from the high pressure volume. As the hydraulic fluid enters or escapes the high pressure volume, the position of the piston is adjusted and, consequently, the effective length of the valve train is adjusted, thus minimizing or eliminating the lash.

During operation of the internal combustion engine, the hydraulic lash adjuster or, more particularly, a fluid reservoir of the hydraulic lash adjuster is provided with a continuous supply of hydraulic fluid. Thus, the hydraulic lash adjuster has a sufficient volume of hydraulic fluid to facilitate the hydraulic length adjustment described above. However, when the internal combustion engine is shut down or during startup of the internal combustion engine, before a sufficient supply of hydraulic fluid is supplied to the hydraulic lash adjuster, the small amount of leakage that occurs during actuation of the hydraulic lash adjuster may deplete the supply of hydraulic fluid before it is effectively replaced. Operation of the hydraulic lash adjuster and valve train during these conditions may result in increased wear and potential damage of the internal combustion engine.

U.S. Pat. No. 4,184,464 to Svihlik teaches an oil recirculation groove formed on the exterior of the plunger of the hydraulic lash adjuster. The oil recirculation groove is in communication with the interior of the plunger through a plunger opening. The oil recirculation groove and plunger opening are positioned axially between the high pressure volume of the hydraulic lash adjuster and an additional groove and passage of the plunger through which oil is supplied to the interior of the plunger. The reduced cross section of the plunger at the circumferential groove may reduce the structural strength of the plunger.

The present disclosure is directed to one or more of the problems set forth above.

SUMMARY OF THE DISCLOSURE

In one aspect, a hydraulic lash adjuster includes a body defining an axial bore and having an open end and a closed end. A hollow piston is telescopically received within the axial bore and defines a fluid reservoir. The hollow piston has a first end disposed within the axial bore and a second end extending outwardly beyond the open end of the body. A high pressure volume is defined by the axial bore and the first end of the hollow piston. The hydraulic lash adjuster also includes a valve mechanism positioned through an opening of the hollow piston and including a valve member having an open position defining a fluid path from the fluid reservoir to the high pressure volume. The valve member also has a closed position in which the fluid reservoir is fluidly blocked from the high pressure volume at the opening. The hollow piston includes a band of radial recirculation openings defining recirculation paths from the high pressure volume to the fluid reservoir along an exterior of the hollow piston. A diameter of each of the radial recirculation openings is smaller than a width of the band.

In another aspect, an internal combustion engine includes a camshaft, an engine valve, and an actuation mechanism for translating rotational motion of the camshaft into linear actuation of the engine valve. The actuation mechanism includes a hydraulic lash adjuster, which includes a hollow piston having a band of radial recirculation openings defining recirculation paths from a leak path of the hydraulic lash adjuster to a fluid reservoir of the hollow piston. The hollow piston also has a continuity of surface area along an axial length.

In yet another aspect, a method of starting an internal combustion engine includes cranking the internal combustion engine. During cranking, a hydraulic lash adjuster of a valve train is actuated and hydraulic fluid is leaked from a high pressure volume of the hydraulic lash adjuster to an exterior of the hydraulic lash adjuster along an exterior of a hollow piston of the hydraulic lash adjuster. The hydraulic fluid leaked from the high pressure volume to a fluid reservoir of the hydraulic lash adjuster is recirculated through a band of radial recirculation openings of the hollow piston during the cranking step such that the internal combustion engine may be started before the fluid reservoir is emptied.

DETAILED DESCRIPTION

Figure 1:
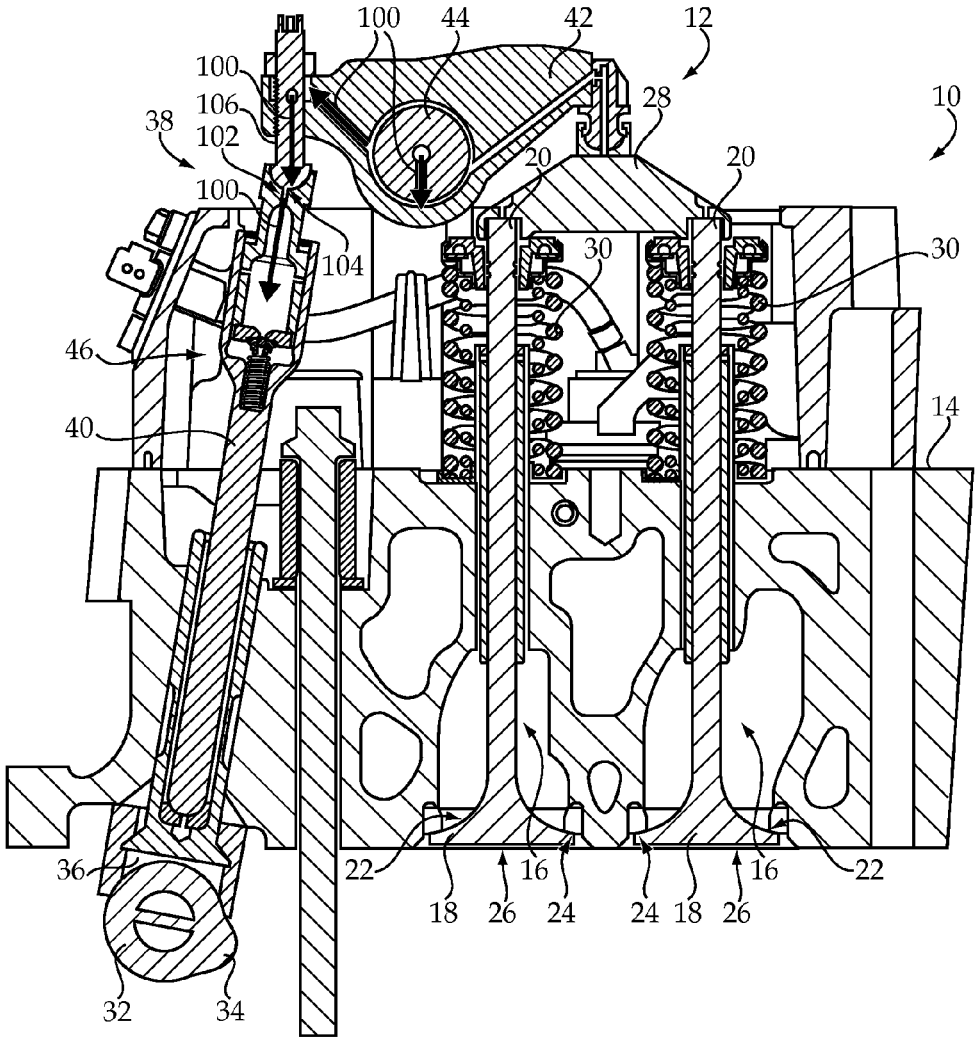
FIG. 1 is a diagrammatic sectional view of an internal combustion engine, according to the present disclosure.

An exemplary embodiment of an internal combustion engine 10 is shown generally in FIG. 1. More specifically, FIG. 1 depicts a portion of the internal combustion engine 10 including an exemplary valve train 12, according to the present disclosure. Although not shown in the Figures, it should be appreciated that the internal combustion engine 10 may include an engine block defining a plurality of cylinders. Each cylinder contains a piston that reciprocates within the respective cylinder. Each piston is connected to a common crankshaft through a connecting rod, such that the reciprocating movement of the pistons turns the crankshaft. Thus, the linear movement of the pistons is translated into rotational motion to produce useful work in a machine with which the internal combustion engine 10 is associated.

Returning to the exemplary embodiment, a cylinder head 14 may be bolted to the engine block, described above, to seal the cylinders. It should also be appreciated that a combustion process takes place within each sealed cylinder to reciprocate the pistons, in the manner described above. The cylinder head 14 may contain at least one intake valve and one exhaust valve for each cylinder; however, most engines include multiple intake valves and multiple exhaust valves per cylinder. According to the exemplary embodiment, two engine valves 16 are shown, each including a valve head 18 and a valve stem 20. The valve head 18 includes a sealing surface 22 adapted to seal against a valve seat 24 about a perimeter of valve ports 26.

According to the exemplary embodiment, the engine valves 16 further include a bridge 28 adapted to contact the valve stems 20 associated with each engine cylinder. A valve spring 30 imparts force between the top of each valve stem 20 and the cylinder head 14, thereby biasing the stem 20 away from the cylinder head 14 and thus biasing the valve head 18 into seating engagement with the corresponding valve seat 24 to close the valves 16. To open the engine valves 16, a camshaft 32 may be rotated such that a lobe 34 pushes against a lifter 36 and, through a series of actuation linkages, pushes the engine valves 16 open.

According to the exemplary embodiment, an actuation mechanism 38 may translate the rotational motion of the camshaft 32 into linear actuation of the engine valves 16. The actuation mechanism 38 may include the camshaft 32 and lifter 36, introduced above, a pushrod 40, and a rocker 42, which pivots about a rocker shaft 44. As should be appreciated, when the lobe 34 pushes against the lifter 36, the rocker 42 is pivoted about the rocker shaft 44 by the pushrod 40. The pivoting movement of the rocker 42 pushes the engine valves 16 open, against the bias of springs 30. When the lobe 34 rotates away from the lifter 36, the valves 16 are closed by the biasing force of the springs 30. Although a specific valve train 12 is shown, it should be appreciated that the present disclosure may be applicable to a variety of different engines having a variety of different valve trains.

The actuation mechanism 38 also includes a hydraulic lash adjuster 46. The hydraulic lash adjuster 46 may be operably positioned within the valve train 12 to protect the valve train components from the engine's normal thermal expansion process. Specifically, the hydraulic lash adjuster 46 uses hydraulic fluid to eliminate clearance or lash between valve train components, in a known manner. According to the exemplary embodiment, the hydraulic lash adjuster 46 is incorporated within the pushrod 40 between the lifter 36 and the rocker 42. However, the hydraulic lash adjuster 46 disclosed herein may be incorporated into the valve train 12 at other locations, depending on design constraints and preference.

Figure 2:
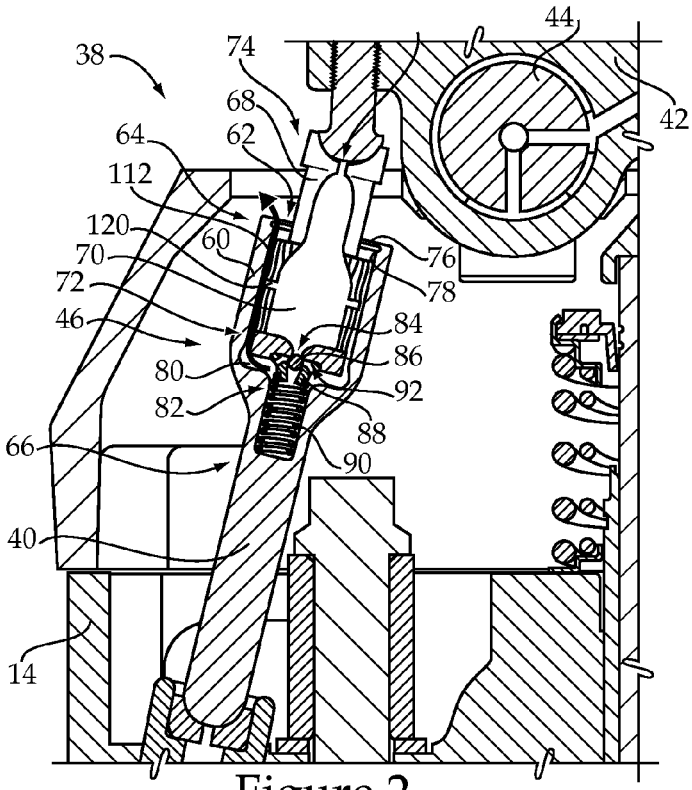
FIG. 2 is a diagrammatic sectional view of the hydraulic lash adjuster of FIG. 1, according to the present disclosure.

Turning now to FIG. 2, the hydraulic lash adjuster 46 will be discussed in greater detail. The hydraulic lash adjuster 46 has a body 60, which, according to the exemplary embodiment, is defined by the pushrod 40. The body 60 defines an axial bore 62 and has an open end 64 and a closed end 66. A hollow piston 68 is telescopically received within the axial bore 62 and defines a fluid reservoir 70. The hollow piston 68 has a first end 72 disposed within the axial bore 62 and a second end 74 extending outwardly beyond the open end 64 of the body 60. A retaining member 76, such as a snap ring, may be disposed within an annular groove 78 of the body 60 and may limit travel of the hollow piston 68 relative to the body 60. A high pressure volume 80 is defined by the axial bore 62 and the first end 72 of the hollow piston 68.

A valve mechanism 82, such as a check valve assembly, is positioned through an opening 84 of the hollow piston 68 and includes a valve member 86 having an open position defining a fluid path from the fluid reservoir 70 to the high pressure volume 80. The valve member 86 also has a closed position, as shown, in which the fluid reservoir 70 is fluidly blocked from the high pressure volume 80 at the opening 84. Specifically, the valve member 86 may be a check ball contained within a check ball cage 88, both of which are biased toward the hollow piston 68 by a spring 90. As shown, the first end 72 of the hollow piston 68 may define a valve seat 92 for the valve member 86.

The hollow piston 68 moves with the rocker 42, while the body 60, or pushrod 40, moves in conjunction with the lifter 36. During operation of the internal combustion engine 10, the hydraulic lash adjuster 46 is pressurized by a hydraulic fluid source, such as an oil gallery, of the internal combustion engine 10. According to the exemplary embodiment, hydraulic fluid may be supplied to the fluid reservoir 70 from a fluid supply path 100 (shown in FIG. 1). Specifically, the hydraulic fluid may be supplied through a hole 102 in the second end 74 of the hollow piston 68. This hole 102 communicates with a similar hole 104 in an adjusting screw 106, which in turn obtains fluid from the rocker 42, which receives fluid from the rocker shaft 44. The pressure from the hydraulic fluid is sufficient to remove clearance in the valve train 12, but not enough to open the valve mechanism 82. The movement of the lifter 36 and pushrod 40, using lobe 34, actually pushes on the body 60 to move the valve member 86 from the closed position, shown, to the open position.

Figure 3:
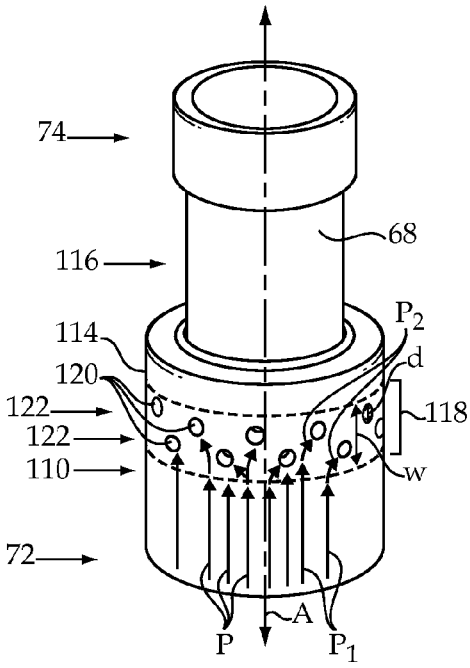
FIG. 3 is a perspective view of the hollow piston of the hydraulic lash adjuster of FIG. 2, according to the present disclosure.

Turning now to FIG. 3, the hollow piston 68 will be discussed in greater detail. As stated above, and referring also to FIGS. 1 and 2, the first end 72 of the hollow piston 68 is telescopically received within the axial bore 62 defined by the body 60. The portion of the hollow piston 68 disposed within the axial bore 62, represented generally as base portion 110, may be shaped and sized to provide a desired clearance and, thus, desired leakage from the high pressure volume 80 to an exterior of the hydraulic lash adjuster 46. Specifically, this clearance defines a leak path 112, shown in FIG. 2, extending from the high pressure volume 80 to an exterior of the hydraulic lash adjuster 46 along an exterior 114 of the hollow piston 68.

A neck portion 116 of the hollow piston 68 may have a width that is smaller than a width of the base 110, and may have a length that is selected to provide desired clearance for the rocker 42 during actuation of the hydraulic lash adjuster 46. The neck portion 116 cooperates with retaining member 76 to limit axial movement of the hollow piston 68 relative to the body 60. The second end 74 of the hollow piston 68 may be shaped to mate with a surface of the adjusting screw 106. The hollow piston 68, which may be made from steel having a hardness and surface finish selected to provide desired operational characteristics, may have different shapes and configurations based on the particular application.

The hollow piston 68 includes a band 118 of radial recirculation openings 120 defining recirculation paths P from the high pressure volume 80 to the fluid reservoir 70 along the exterior 114 of the hollow piston 68. As shown, a diameter d of each of the radial recirculation openings 120 may be smaller than a width w of the band 118 and, according to some embodiments, the radial recirculation openings 120, which may be formed by cross drilling, may have a uniform diameter d. The band 118 includes at least three of the radial recirculation openings 120 and, as shown in the exemplary embodiment, may include a plurality of axially spaced rows 122 of openings 120. Although two rows 122 are shown, it should be appreciated that the band 118 may include any number of rows 122. Preferably, the radial recirculation openings 120 are circumferentially spaced such that the hollow piston 68 has a continuity of surface area along an axial length, relative to axis A.

INDUSTRIAL APPLICABILITY

The present disclosure may be applicable to hydraulic lash adjusters for use in valve trains of an internal combustion engine. Further, the present disclosure may be applicable to hydraulic lash adjusters having controlled leakage, or leak-down, which may deplete the amount of hydraulic fluid in the fluid reservoir of the hydraulic lash adjuster during times when the internal combustion engine is starting up or is not operating. Yet further, the present disclosure may be applicable to a means for recirculating hydraulic fluid from a leak path of the hydraulic lash adjuster into the fluid reservoir, particularly during engine startup.

A valve train 12 of an internal combustion engine 10 may include engine valves 16, each having a valve head 18 and a valve stem 20. Valve springs 30 bias the valve stems 20 away from a cylinder head of the engine 10 and, thus, bias the valve heads 18 into seating engagement with corresponding valve seats 24 to close the valves 16. To open the engine valves 16, a camshaft 32 may be rotated such that a lobe 34 pushes against a lifter 36 and, through a series of linkages, pushes the engine valves 16 open. More specifically, an actuation mechanism 38 may translate the rotational motion of the camshaft 32 into linear actuation of the engine valves 16. The actuation mechanism 38 may include, in addition to the camshaft 32 and lifter, a pushrod 40 and a rocker 42, which pivots about a rocker shaft 44. As should be appreciated, when the lobe 34 pushes against the lifter 36, the rocker 42 is pivoted about the rocker shaft 44 by the pushrod 40. The pivoting movement of the rocker 42 pushes the engine valves 16 open, using bridge 28, against the bias of springs 30.

The actuation mechanism 38 also includes a hydraulic lash adjuster 46 to reduce clearance, or lash, between valve train components. The hydraulic lash adjuster 46 has a body 60, which, according to the exemplary embodiment, is defined by the pushrod 40. The body 60 defines an axial bore 62 and has an open end 64 and a closed end 66. A hollow piston 68 is telescopically received within the axial bore 62 and defines a fluid reservoir 70, which receives hydraulic fluid from a fluid supply path 100. The hollow piston 68 has a first end 72 disposed within the axial bore 62 and a second end 74 extending outwardly beyond the open end 64 of the body 60. A high pressure volume 80 is defined by the axial bore 62 and the first end 72 of the hollow piston 68. A valve mechanism 82 is positioned through an opening 84 of the hollow piston 68 and includes a valve member 86 movable, during actuation of the hydraulic lash adjuster 46, to allow small quantities of hydraulic fluid from the fluid reservoir 70 to enter the high pressure volume 80. Changes in the amount of hydraulic fluid in the hydraulic lash adjuster 46 changes the effective length of the valve train 12, thus reducing lash.

As pressure from the rocker 42 is applied to the hollow piston 68, such as when the valve springs 30 bias the engine valves 16 closed, this action may force small amounts of hydraulic fluid from the high pressure volume 80 to an exterior of the hydraulic lash adjuster along a leak path 112. During operation, the hydraulic lash adjuster 46 or, more particularly, the fluid reservoir 70 of the hydraulic lash adjuster 46 is provided with a continuous supply of hydraulic fluid. Thus, the hydraulic lash adjuster 46 has a sufficient volume of hydraulic fluid to facilitate the hydraulic length adjustment described above. However, when the internal combustion engine 10 is shut down or during startup of the internal combustion engine 10, before a sufficient supply of hydraulic fluid is supplied to the hydraulic lash adjuster 46, the small amount of leakage that occurs during actuation of the hydraulic lash adjuster 46 may deplete the supply of hydraulic fluid before it is effectively replaced.

To replenish the supply of hydraulic fluid, particularly during engine startup, the hollow piston 68 is provided with a band 118 of radial recirculation openings 120 defining recirculation paths P from the high pressure volume 80 to the fluid reservoir 70 along the exterior 114 of the hollow piston 68. Specifically, for example, the internal combustion engine 10 may be started by first cranking the engine 10. During cranking, the valve train 12 and hydraulic lash adjuster 46 operate as described above. Thus, hydraulic fluid is leaked from the high pressure volume 80 to an exterior of the hydraulic lash adjuster 46 along the exterior 114 of the hollow piston 68. This leaked hydraulic fluid may be recirculated from the high pressure volume 80 to the fluid reservoir 70 through the band 118 of radial recirculation openings 120.

As shown in FIG. 3, the recirculation of leaked hydraulic fluid may include recirculating the hydraulic fluid along a first path $P_1$ parallel with a centerline, or axis A, of the hydraulic lash adjuster 46, and recirculating the hydraulic fluid along a second path $P_2$ having an angle greater than zero with respect to the centerline A. Specifically, as higher pressure hydraulic fluid travels along leak path 112, which may be substantially parallel with axis A, it may be drawn into the lower pressure fluid reservoir 70 through radial recirculation openings 120 along angled paths $P_2$. By recirculating the leaked hydraulic fluid, the internal combustion engine 10 may be started before the fluid reservoir 70 is emptied. Once the internal combustion engine 10 is started, hydraulic fluid will be continuously supplied to the hydraulic lash adjuster 46 along the fluid supply path 100.

The hydraulic lash adjuster described herein may effectively reduce depletion of hydraulic fluid from the hydraulic lash adjuster during engine operation and, particularly, during engine startup. Thus, the risk of engine wear and potential damage during engine cranking due to insufficient hydraulic fluid in the hydraulic lash adjuster may be reduced. The band of radial recirculation openings described herein does not require the machining of a circumferential groove within the hollow piston, which may result in a reduced cross section and reduced structural strength of the hollow piston. Further, by limiting the recirculation improvement to one machining process, i.e., drilling, lower costs may be realized than recirculation options that require multiple machining operations.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A hydraulic lash adjuster, comprising:

a body defining an axial bore and having an open end and a closed end;

a hollow piston telescopically received within the axial bore and defining a fluid reservoir, wherein the hollow piston has a first end disposed within the axial bore and a second end extending outwardly beyond the open end of the body;

a high pressure volume defined by the axial bore and the first end of the hollow piston; and a valve mechanism positioned through an opening of the hollow piston and including a valve member having an open position defining a fluid path from the fluid reservoir to the high pressure volume and a closed position in which the fluid reservoir is fluidly blocked from the high pressure volume at the opening;

wherein the hollow piston includes a band of radial recirculation openings defining recirculation paths from the high pressure volume to the fluid reservoir along an exterior of the hollow piston, wherein a diameter of each of the radial recirculation openings is smaller than a width of the band.

2. The hydraulic lash adjuster of claim 1, wherein the radial recirculation openings are uniform diameter cross drillings.

3. The hydraulic lash adjuster of claim 2, wherein the band includes at least three radial recirculation openings.

4. The hydraulic lash adjuster of claim 3, wherein the band includes a plurality of axially spaced rows of radial recirculation openings.

5. The hydraulic lash adjuster of claim 3, wherein the hollow piston has a continuity of surface area along an axial length.

6. The hydraulic lash adjuster of claim 1, wherein the body is a pushrod.

7. The hydraulic lash adjuster of claim 6, wherein the first end of the hollow piston defines a valve seat for the valve member.

8. A method of starting an internal combustion engine, the method comprising steps of:

cranking the internal combustion engine;

actuating a hydraulic lash adjuster of a valve train of the internal combustion during the cranking step;

leaking hydraulic fluid from a high pressure volume of the hydraulic lash adjuster to an exterior of the hydraulic lash adjuster along an exterior of a hollow piston of the hydraulic lash adjuster during the cranking step;

recirculating hydraulic fluid leaked from the high pressure volume to a fluid reservoir of the hydraulic lash adjuster through a band of radial recirculation openings of the hollow piston during the cranking step; and starting the internal combustion engine before the fluid reservoir is emptied.

9. The method of claim 8, wherein the recirculating step includes recirculating the hydraulic fluid along a first path parallel with a centerline of the hydraulic lash adjuster, and recirculating the hydraulic fluid along a second path having an angle greater than zero with respect to the centerline.

10. The method of claim 9, wherein the recirculating step includes recirculating the hydraulic fluid through a plurality of axially spaced rows of radial recirculation openings.

11. The method of claim 8, wherein the starting step includes supplying hydraulic fluid from a fluid supply path through an end of the hollow piston and into the fluid reservoir.

* * * * *